US009159515B2

(12) United States Patent
Iwamoto et al.

(10) Patent No.: US 9,159,515 B2
(45) Date of Patent: Oct. 13, 2015

(54) ELECTROMAGNETIC RELAY

(71) Applicant: FUJITSU COMPONENT LIMITED, Tokyo (JP)

(72) Inventors: Daiei Iwamoto, Tokyo (JP); Takashi Yuba, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 127 days.

(21) Appl. No.: 13/855,998

(22) Filed: Apr. 3, 2013

(65) Prior Publication Data

US 2013/0278362 A1 Oct. 24, 2013

(30) Foreign Application Priority Data

Apr. 19, 2012 (JP) ..... 2012-095885

(51) Int. Cl.
*H01H 51/22* (2006.01)
*H01H 1/26* (2006.01)

(52) U.S. Cl.
CPC ..... *H01H 51/22* (2013.01); *H01H 1/26* (2013.01); *H01H 51/2227* (2013.01); *H01H 51/2281* (2013.01)

(58) Field of Classification Search
CPC ..... H01H 51/2227
See application file for complete search history.

(56) References Cited

U.S. PATENT DOCUMENTS 3,387,240 A * 6/1968 Koppensteiner ..... 335/153
3,418,610 A * 12/1968 Hammond ..... 335/205
4,156,820 A * 5/1979 Fukuda et al. ..... 307/116
4,621,246 A * 11/1986 Nagamoto et al. ..... 335/78
4,668,928 A * 5/1987 Davis et al. ..... 335/79
4,688,010 A * 8/1987 Nobutoki et al. ..... 335/128
4,707,675 A 11/1987 Motoyama et al.
4,843,360 A * 6/1989 Yoshino et al. ..... 335/80
5,473,297 A 12/1995 Sako et al.
5,994,987 A * 11/1999 Passow ..... 335/78
6,046,661 A * 4/2000 Reger et al. ..... 335/185
6,670,871 B1 12/2003 Saso et al.
8,203,403 B2 * 6/2012 Moeller et al. ..... 335/78

(Continued)

FOREIGN PATENT DOCUMENTS

CH 522285 6/1972
DE 9208114 10/1992

(Continued)

OTHER PUBLICATIONS

European extended search report dated Jul. 29, 2013 in Appln. No. 13164072.4.

(Continued)

*Primary Examiner* — Mohamad Musleh
(74) *Attorney, Agent, or Firm* — Staas & Halsey LLP

(57) ABSTRACT

An electromagnetic relay includes: a yoke capable of changing a magnetic pole thereof by an electromagnet; an armature that is magnetized by a permanent magnet and contacts with or separates from the yoke in accordance with the magnetic pole of the yoke; a movable contact that contacts with a fixing contact; an elastic body that biases the movable contact; and a pressing member that presses the elastic body in accordance with a movement of the armature to cause the movable contact to at least contact with or separate from the fixing contact, wherein a cover fixing the permanent magnet and the armature, and the pressing member are integrally formed.

8 Claims, 9 Drawing Sheets

(56) References Cited

U.S. PATENT DOCUMENTS

| | | | | |
|---|---|---|---|---|
| 8,222,981 | B1 * | 7/2012 | Zarbock et al. | 335/128 |
| 8,222,982 | B2 * | 7/2012 | Sullivan et al. | 335/166 |
| 8,564,386 | B2 * | 10/2013 | Moeller et al. | 335/78 |
| 2009/0033446 | A1 | 2/2009 | Gruner et al. | |
| 2010/0123533 | A1 * | 5/2010 | Helmreich | 335/188 |

FOREIGN PATENT DOCUMENTS

| | | |
|---|---|---|
| EP | 1968083 | 9/2008 |
| JP | 3-38690 | 6/1991 |
| JP | 6-236725 | 8/1994 |
| JP | 6-251682 | 9/1994 |
| JP | 2580919 | 7/1998 |
| JP | 10-255631 | 9/1998 |
| JP | 2000-311570 | 11/2000 |
| JP | 2001-126601 | 5/2001 |
| JP | 2003-157755 | 5/2003 |
| JP | 2006-179349 | 7/2006 |
| JP | 2009-212094 | 9/2009 |

OTHER PUBLICATIONS

Patent Abstracts of Japan, Publication No. 2001-126601, Published May 11, 2001.

Patent Abstracts of Japan, Publication No. 10-255631, Published Sep. 25, 1998.

Patent Abstracts of Japan, Publication No. 2009-212094, Published Sep. 17, 2009.

Patent Abstracts of Japan, Publication No. 06-236725, Published Aug. 23, 1994.

Patent Abstracts of Japan, Publication No. 06-251682, Published Sep. 9, 1994.

Patent Abstracts of Japan, Publication No. 2000-311570, Published Nov. 7, 2000.

Patent Abstracts of Japan, Publication No. 2006-179349, Published Jul. 6, 2006.

Patent Abstracts of Japan, Publication No. 2003-157755, Published May 30, 2003.

* cited by examiner

ELECTROMAGNETIC RELAY

CROSS-REFERENCE TO RELATED APPLICATION

This application is based upon and claims the benefit of priority of the prior Japanese Patent Application No. 2012-095885, filed on Apr. 19, 2012, the entire contents of which are incorporated herein by reference.

FIELD

A certain aspect of the embodiments discussed herein is related to an electromagnetic relay.

BACKGROUND

Japanese Patent Application Publication No. 2001-126601 (hereinafter, described as Patent Document 1) discloses an electromagnetic relay that includes a yoke capable of changing a magnetic pole thereof by an electromagnet, and an armature magnetized by a permanent magnet. The magnetic pole of the yoke is changed by changing the polarity of the electromagnet. This causes the armature to contact with or separate from the yoke. A movable contact is biased by an elastic body, and a pressing member presses the elastic body in accordance with the movement of the armature. This causes a fixing contact and the movable contact to contact with or separate from each other. The function as the electromagnetic relay is achieved as described above.

SUMMARY

According to an aspect of the present invention, there is provided an electromagnetic relay including: a yoke capable of changing a magnetic pole thereof by an electromagnet; an armature that is magnetized by a permanent magnet and contacts with or separates from the yoke in accordance with the magnetic pole of the yoke; a movable contact that contacts with a fixing contact; an elastic body that biases the movable contact; and a pressing member that presses the elastic body in accordance with a movement of the armature to cause the movable contact to at least contact with or separate from the fixing contact, wherein a cover fixing the permanent magnet and the armature, and the pressing member are integrally formed.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A member transmitting the movement of the armature to the pressing member is formed from two or more members in Patent Document 1. Thus, the electromagnetic relay is hardly downsized, and production cost is difficult to be reduced. Furthermore, when the elastic body is used as a conductor for supplying electrical current to the movable contact, the elastic body is preferably made thick to reduce an electric resistance. However, the elastic constant increases as the elastic body becomes thicker.

Hereinafter, a description will be given of an embodiment of the present invention with reference to the drawings.

First Embodiment

Figure 1:
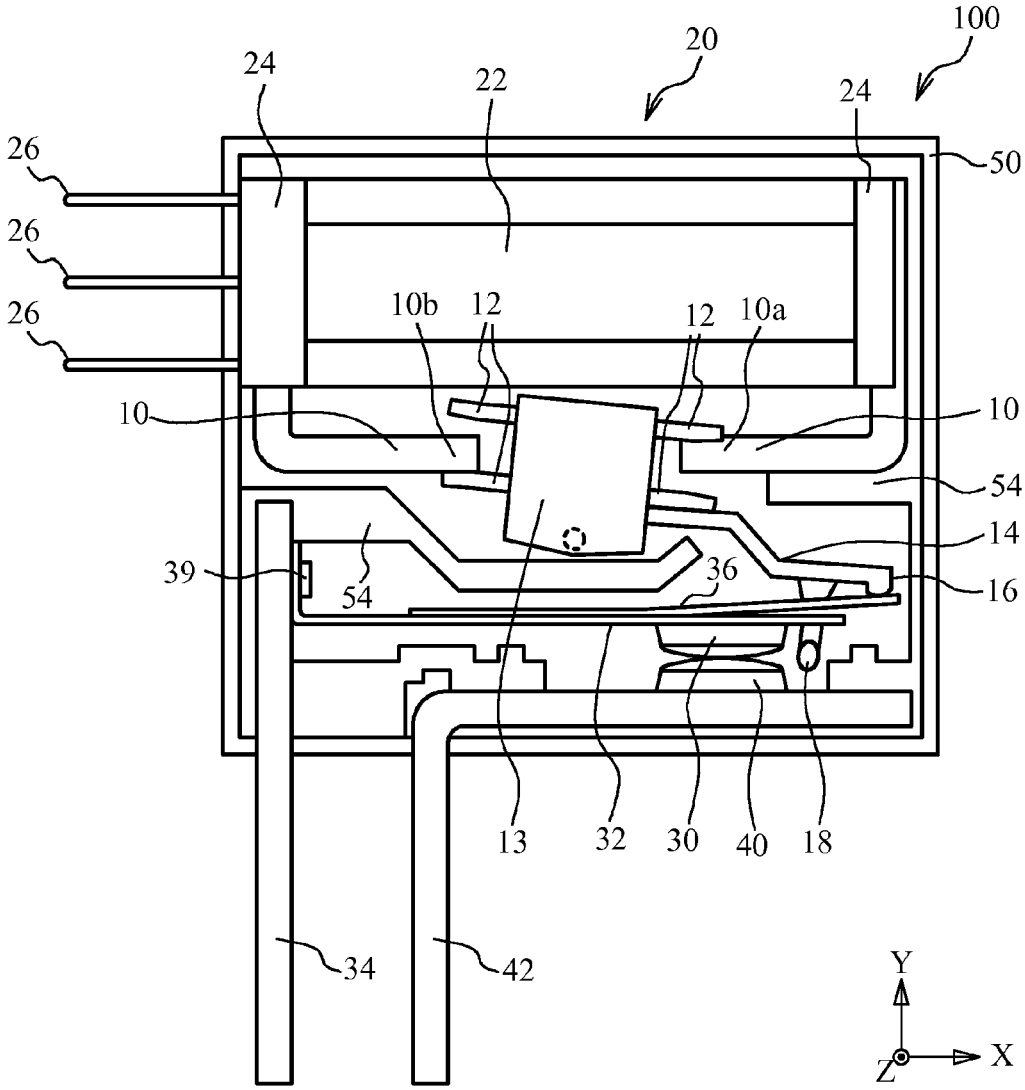
FIG. 1 is an exploded front view of an electromagnetic relay in accordance with a first embodiment.

FIG. 1 is an exploded front view of an electromagnetic relay 100 in accordance with a first embodiment. FIG. 1 illustrates a side view in which a part of a base housing components is removed. A direction of a pair of yokes 10 is defined as an X direction, a direction perpendicular to the X direction is defined as a Y direction, and a direction from a bottom surface to a front surface of the page is defined as a Z direction. The X, Y, and Z directions are indicated in the same manner in the drawings hereinafter. A base 50 houses an electromagnet 20, the yokes 10, armatures 12, a cover 13, a contact pressing member 16, a separation pressing member 18, a connecting member 14, a movable contact 30, a movable spring 32, a movable terminal 34, a contact spring 36, a fixing contact 40, and a fixing terminal 42.

A coil wire 22 is wound around a bobbin 24 to form the electromagnet 20. A terminal 26 is electrically coupled to the coil wire. A pair of the yokes 10 is magnetically coupled to both sides of the electromagnet 20. An edge portion 10*a* of one of a pair of the yokes 10 has a magnetic pole opposite to that of an edge portion 10*b* of the other one. When the direction of electric current flowing through the coil wire 22 is changed, the polarity of the electromagnet 20 inverts. As described above, the electromagnet can change the magnetic poles of the yokes 10. The armatures 12 are magnetized by a permanent magnet, and contact with or separate from the yokes 10 in accordance with the magnetic poles of the yokes 10. A part of the armatures 12 and the permanent magnet (see, e.g., FIG. 2B) are fixed by the cover 13.

The movable contact 30 is electrically coupled to the movable terminal 34 through the movable spring (elastic body) 32. The movable spring 32 is fixed to the movable terminal 34 by a fixing portion 39. The fixing contact 40 is electrically coupled to the fixing terminal 42. When the movable contact 30 contacts with the fixing contact 40, the movable terminal 34 is electrically coupled to the fixing terminal 42. When the movable contact 30 separates from the fixing contact 40, the movable terminal 34 is electrically disconnected with the fixing terminal 42. The movable contact 30 is biased by the movable spring 32 and the contact spring 36 so that the movable terminal 34 separates from the fixing terminal 42. When the contact pressing member 16 presses the movable spring 32 and the contact spring 36 downward, the movable contact 30 contacts with the fixing contact. When the separation pressing member 18 presses the movable spring 32 and the contact spring 36 upward, the movable contact 30 separates from the fixing contact. The connecting member 14 connects the cover 13 to the contact pressing member 16 and the separation pressing member 18. Plate-like springs such as the movable spring 32 and the contact spring 36 are described as an elastic body, but it is sufficient if the elastic body biases the movable contact 30.

Figure 2A:
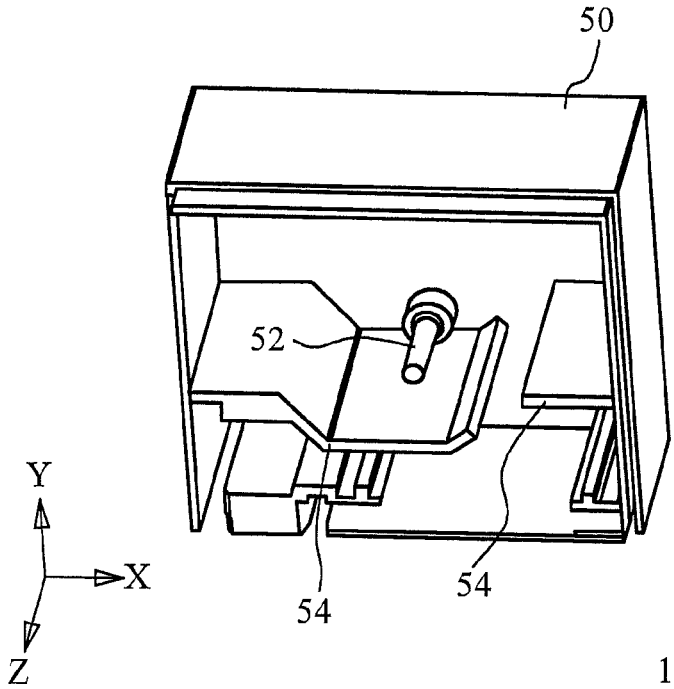
FIG. 2A is a perspective view of a base.
Figure 2B:
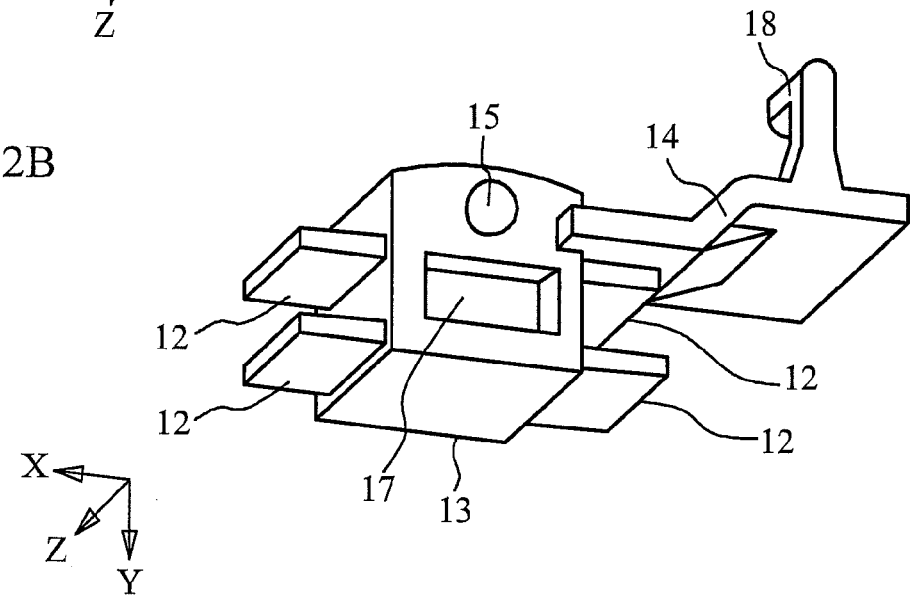
FIG. 2B is a perspective view illustrating a cover and a pressing member.
Figure 2C:
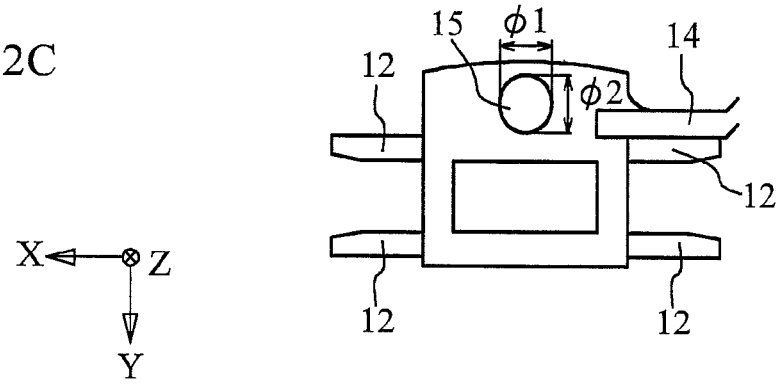
FIG. 2C is a front view of the cover.

FIG. 2A is a perspective view of the base, FIG. 2B is a perspective view of the cover and the pressing member, and FIG. 2C is a front view of the cover. As illustrated in FIG. 2A, the base 50 includes a protrusion 52. The protrusion 52 function as a rotation axis 53 of the cover 13. The protrusion 52 has a cross section of, for example, a true circle. As illustrated in FIG. 2B and FIG. 2C, a recess portion is formed in the cover 13, and a permanent magnet 17 is located in the recess portion. A hole 15 is formed in the cover 13. The cover 13, the connecting member 14, and the pressing members 16 and 18 are integrally formed of, for example, a resin. The movable spring 32 and the contact spring 36 are not unified with the cover 13, the connecting member 14, and the pressing members 16 and 18, and thus can be detached from the pressing members 16 and 18.

The first embodiment integrally forms the cover 13 and the pressing members 16 and 18. For example, the cover 13 and the pressing members 16 and 18 are molded with a mold. This eliminates another member such as a card disclosed in Patent Document 1 that connects the armatures 12 to the pressing members 16 and 18. Thus, an electromagnetic relay 100 can be downsized. In addition, the number of components can be reduced, and thus the production cost can be reduced. Furthermore, the electromagnetic relay 100 excels in resistance to shock.

Figure 3A:
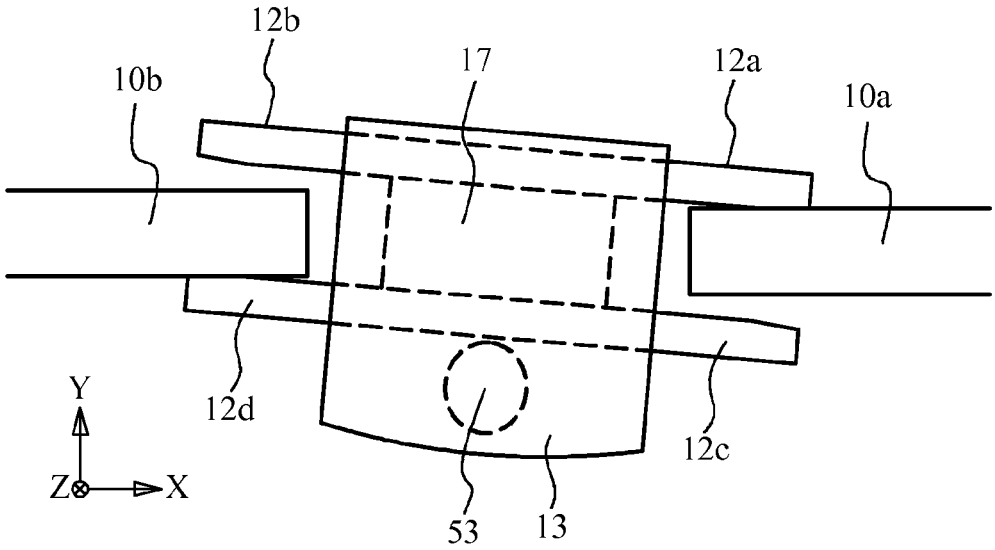
FIG. 3A and FIG. 3B are diagrams illustrating movements of armatures.
Figure 3B:
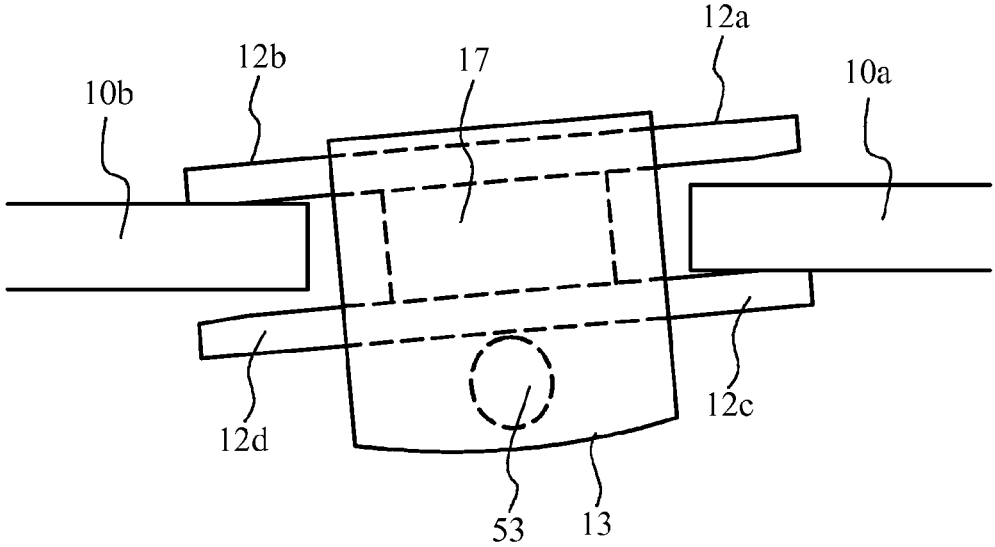

FIG. 3A and FIG. 3B are diagrams illustrating movements of the armatures. As illustrated in FIG. 3A, when the edge portion 10*a* of the yoke 10 has the same polarity as those of the armatures 12*c* and 12*d* and the edge portion 10*b* of the yoke 10 has the same polarity as those of the armatures 12*a* and 12*b*, the armature 12*a* contacts with the edge portion 10*a* and the armature 12*d* contacts with the edge portion 10*b*. As illustrated in FIG. 3B, when the edge portion 10*a* has the same polarity as those of the armatures 12*a* and 12*b* and the edge portion 10*b* has the same polarity as those of the armatures 12*c* and 12*d*, the armature 12*c* contacts with the edge portion 10*a* and the armature 12*b* contacts with the edge portion 10*b*. A pair of the yokes 10 is provided so as to behave as described above. The armatures 12 are provided so as to sandwich the edge portions 10*a* and 10*b* of a pair of the yokes 10. The rotation of the cover 13 causes the armatures 12 to contact with or separate from the edge portions 10*a* and 10*b*. Cost can be reduced by, for example, making two armatures 12 have the identical shape.

As illustrated in FIG. 2C, the hole 15 formed in the cover 13 has an oval shape. When $\phi 1$ represents a minor axis in the X direction of the hole 15 and $\phi 2$ represents a major axis in the Y direction, $\phi 2$ is greater than $\phi 1$ ($\phi 2 > \phi 1$). For example, in FIG. 3A and FIG. 3B, when at least one of four contact points between the yokes 10 and the armatures 12 has worn, a gap is formed between the yoke 10 and the armature 12. In addition, gaps between the yokes 10 and the armatures 12 differ from each other depending on variability among the members. When the gap is formed between the yoke 10 and the armature 12, the yoke 10 can not sufficiently contact with the armature 12. Thus, when the shock is applied to the electromagnetic relay 100, the yoke 10 is caused to separate from the armature 12. Therefore, the resistance to shock degrades.

The first embodiment configures the hole 15 to have an oval shape, thus the cover 13 can easily move in the Y direction. On the other hand, the movement in the X direction is regulated. The above configuration allows the yokes 10 to sufficiently contact with the armatures 12 even when the gap between the yoke 10 and the armature 12 differs from other gaps at one of the contact points between the yokes 10 and the armatures 12. Thus, the degradation of the resistance to shock is suppressed. Furthermore, the movement of the cover 13 in the X direction is regulated. Therefore, the positional accuracy of the cover 13 in the X direction can be ensured. The protrusion 52 may be formed in the cover 13, and the hole may be formed in the base 50. That is to say, it is sufficient if one of the base 50 and the cover 13 includes the hole 15 and the other one includes the protrusion 52 fitting in the hole 15 at a center of rotation of the cover 13. A gap between the hole 15 and the protrusion 52 in an arrangement direction of a pair of the yokes 10 (e.g. X direction) is preferably narrower than that in a direction intersecting with the arrangement direction (e.g. Y direction).

In addition, the hole 15 is not located on the center line of the yoke 10, and is located outside a pair of the armatures 12. This configuration allows the volume of the permanent magnet 17 located between the armatures 12 to be sufficiently secured, and a relay that excels in resistance to shock to be provided.

Figure 4:
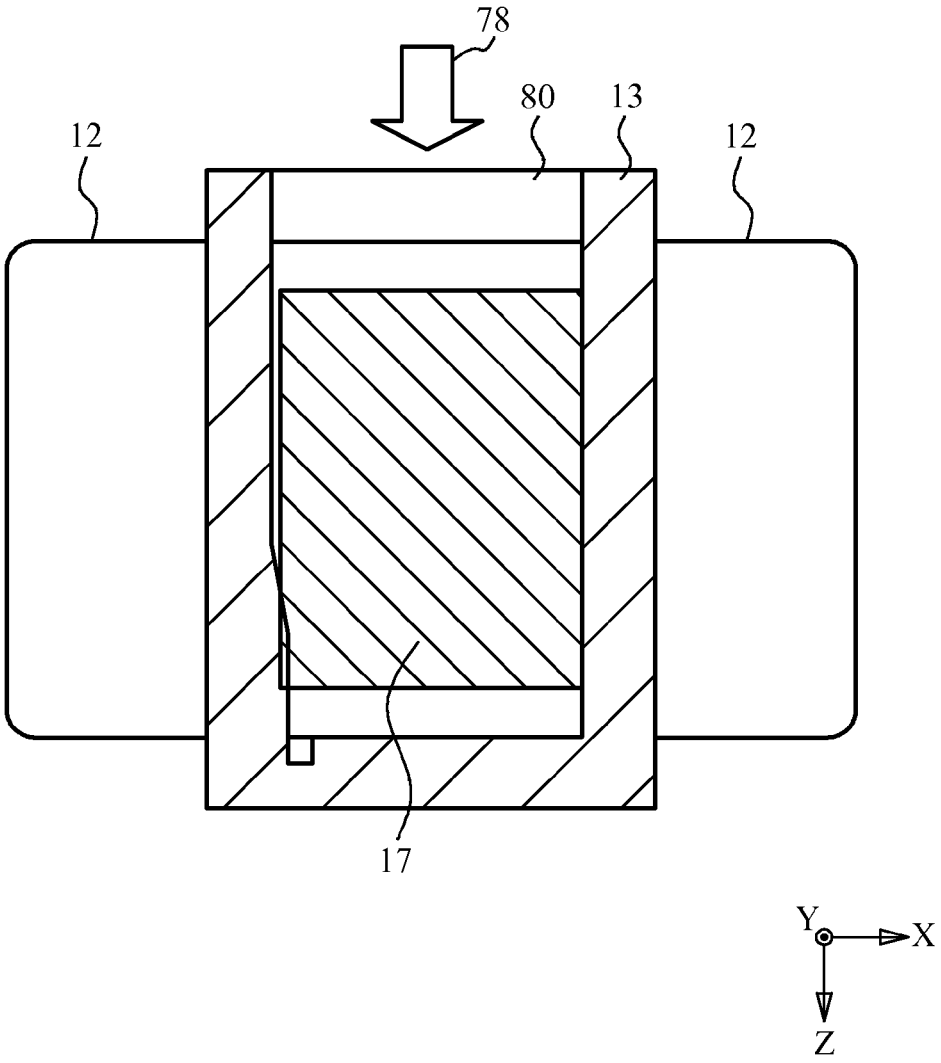
FIG. 4 is a cross-sectional view of the cover.

FIG. 4 is a cross-sectional view of the cover in an XZ plane. As illustrated with an arrow 78 in FIG. 4, the cover 13 and the pressing member are integrally molded, and the permanent magnet 17 is then inserted from an insertion opening 80. The permanent magnet 17 may be embedded during mold-forming. However, in this case, an equipment for magnetizing the armatures 12 is used after the mold-forming. As illustrated in FIG. 4, when the permanent magnet 17 is inserted after the mold-forming, the size of the permanent magnet 17 is easily changed. Thus, the magnetization can be easily executed. Therefore, the equipment for magnetizing the armatures 12 becomes unnecessary. In addition, the electromagnetic relay can have variations differing in performance and cost. The permanent magnet 17 may be, for example, a samarium-cobalt magnet.

Figure 5A:
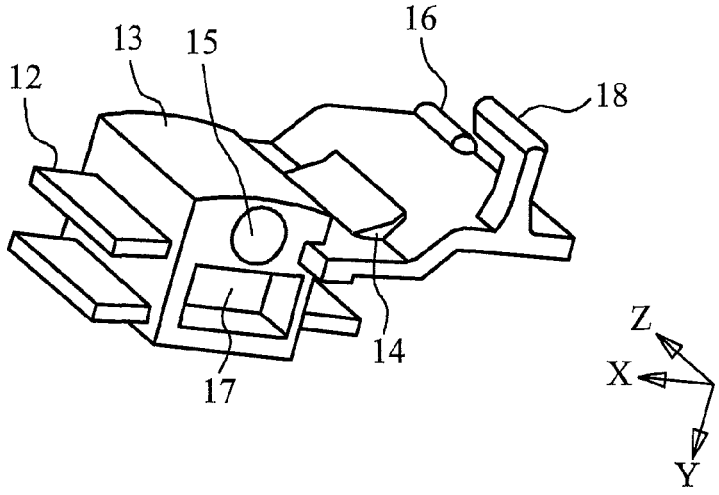
FIG. 5A is a perspective view of the cover and the pressing member.
Figure 5B:
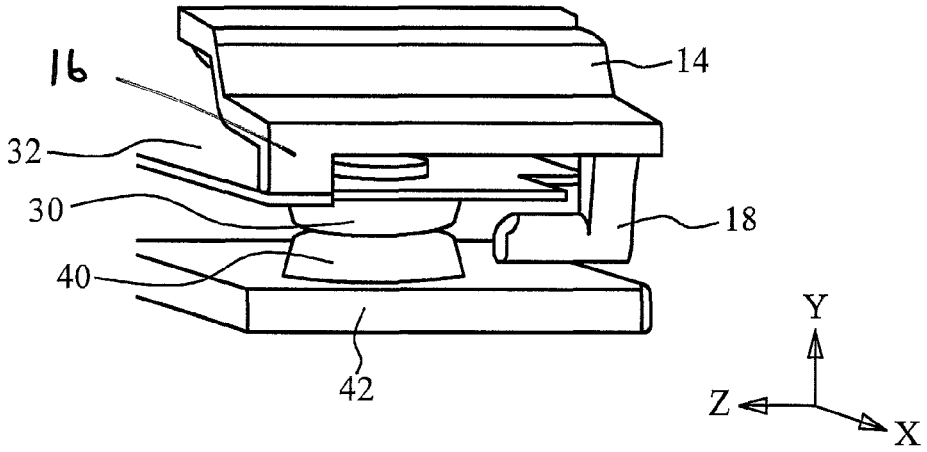
FIG. 5B and FIG. 5C are perspective views of the pressing member and contacts.
Figure 5C:
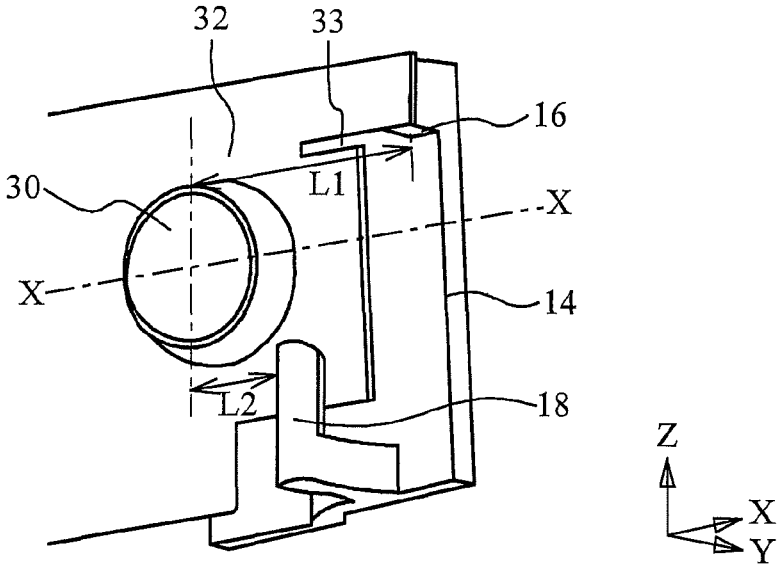

FIG. 5A is a perspective view of the cover and the pressing member, and FIG. 5B and FIG. 5C are perspective views of the pressing member and contacts. As illustrated in FIG. 5A, the contact pressing member 16 (first member) and the separation pressing member 18 (second member) are provided as a pressing member. As illustrated in FIG. 5B and FIG. 5C, the contact pressing member 16 presses the movable spring 32 toward −Y direction to cause the movable contact 30 to contact with the fixing contact 40. On the other hand, the separation pressing member 18 presses the movable spring 32 toward +Y direction to cause the movable contact 30 to separate from the fixing contact 40. The movable contact 30 and the fixing contact 40 are sometimes welded by inrush current. In addition to a biasing force from the movable spring 32, the separation pressing member 18 can separate the movable contact 30 from the fixing contact 40 as described above. Thus, welding failure of the contacts is suppressed.

In addition, a distance L1 from the movable contact 30 to the contact pressing member 16 is greater than a distance L2 from the movable contact 30 to the separation pressing member 18. This configuration allows the separation pressing member 18 to press the movable spring 32 with a great force compared to the contact pressing member 16. Therefore, the welding failure is further suppressed.

A distance from the movable spring 32 to the separation pressing member 18 when the separation pressing member 18 separates from the movable spring 32 is greater than a distance from the movable spring 32 to the contact pressing member 16 when the contact pressing member 16 separates from the movable spring 32. This configuration causes the separation pressing member 18 with a velocity to hit the movable spring 32 when the separation pressing member 18 contacts with the movable spring 32. This impact enables to remove the contacts from each other. Thus, the welding failure of the contacts can be further suppressed.

The contact pressing member 16 and the separation pressing member 18 press the movable spring 32 at opposing sides with respect to line X-X (line connecting a fulcrum of the movable spring 32 to the movable contact 30). The above configuration further suppresses the welding failure of the contacts because the movable spring 32 is twisted after the contact pressing member 16 or the separation pressing member 18 contacts with the movable spring 32. Moreover, at this time, the movable contact 30 slides on the fixing contact 40 in the Z direction after the fixing contact 40 contacts with the movable contact 30 or before the fixing contact 40 separates from the movable contact 30. Thus, impurities adhering to the surfaces of the contacts can be rubbed off. Therefore, the failure of the contact or the rise in contact resistance of the contact causing heat generation can be suppressed. The above configuration has a cleaning function of the contact.

Furthermore, a groove 33 is located between regions of the movable spring 32 in which the contact pressing member 16 and the separation pressing member 18 contact therewith. This configuration allows an elastic constant of the movable spring 32 to be reduced. Both the contact pressing member 16 and the separation pressing member 18 are provided in the present embodiment, but it is sufficient if at least one of them is provided.

Figure 6A:
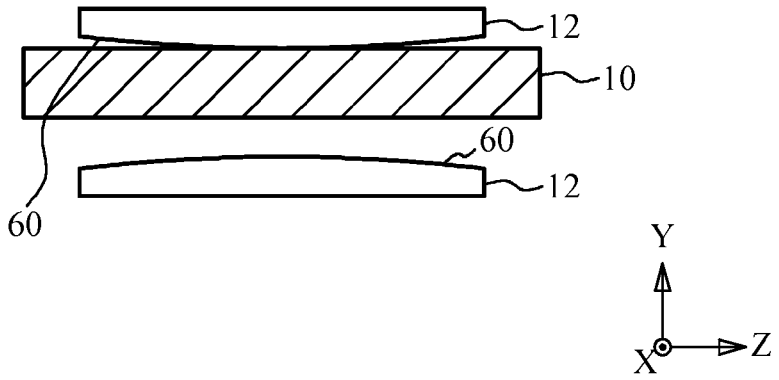
FIG. 6A and FIG. 6B are enlarged views of a yoke and the armatures.
Figure 6B:
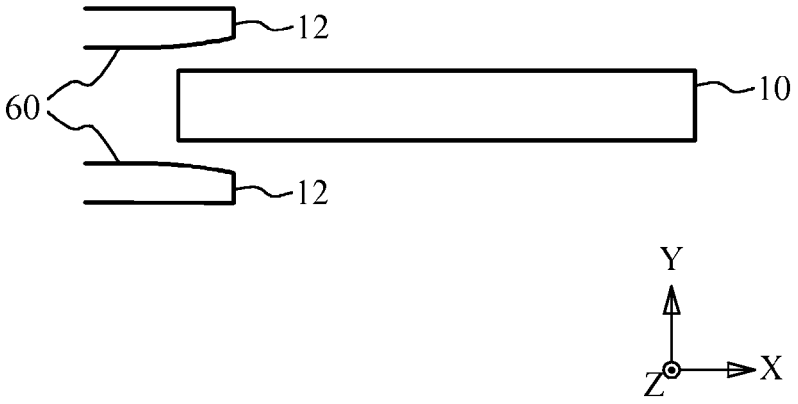

FIG. 6A and FIG. 6B are enlarged views of the yoke and the armatures. As illustrated in FIG. 6A, when the cross-sections of the armatures 12 and the yoke 10 are viewed from tips of the armatures 12, surfaces 60 of the armatures 12 facing the upper and lower surfaces of the yoke 10 bulge toward the yoke 10. In addition, the surfaces 60 have a curved shape so that the curvature increases closer to the both sides of the armatures 12. As illustrated in FIG. 6B, when the armatures 12 and the yoke 10 are viewed from the front, the surfaces 60 of the armatures 12 facing the upper and lower surfaces of the yoke 10 incline so that a distance separating from the upper surface or the lower surface of the yoke 10 becomes greater closer to the tips of the armatures 12. In addition, the surfaces 60 have a curved shape so that the curvature increases closer to the tips.

As described above, inclination of the surface 60 can increase an area of contact between the armature 12 and the yoke 10. Thus, the magnetic characteristics can be stabilized. In addition, the surface 60 having a curved shape can further stabilize the magnetic characteristics.

Figure 7A:
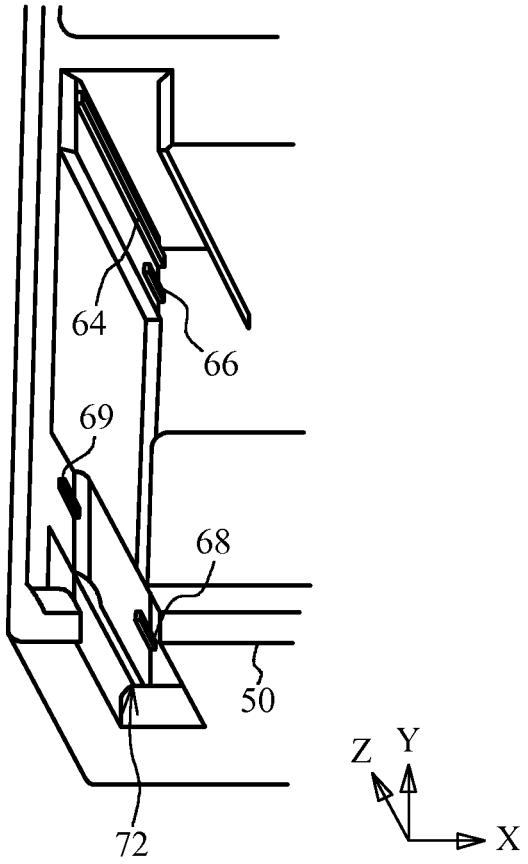
FIG. 7A and FIG. 7B are perspective views of the base and a movable terminal.
Figure 7B:
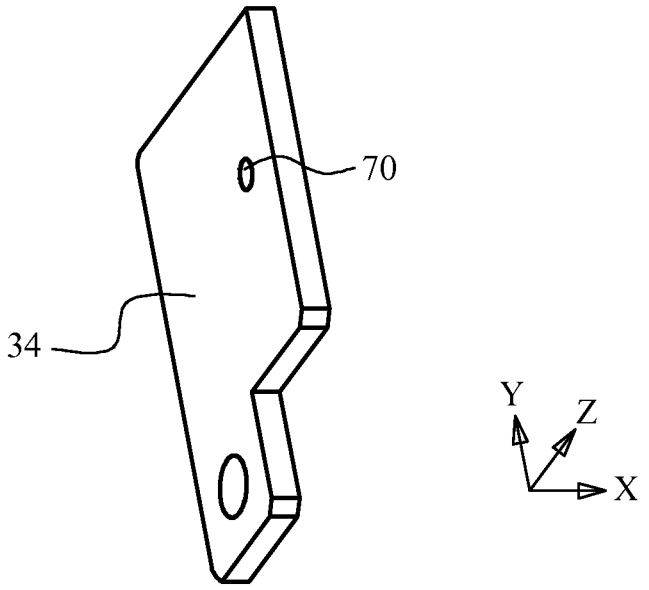

FIG. 7A and FIG. 7B are perspective views of the base and the movable terminal. As illustrated in FIG. 7A, a slit 72 in which the movable terminal 34 is fitted is formed in the base 50. Ribs 64, 66, 68, and 69 are located in an inner surface of the base 50. As illustrated in FIG. 6B, a protrusion 70 is located in the movable terminal 34.

Figure 8A:
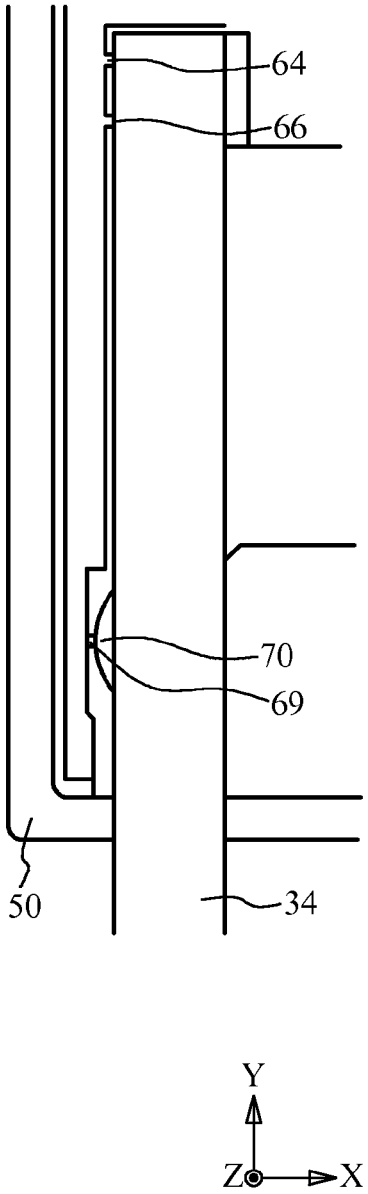
FIG. 8A and FIG. 8B are a front view and a cross-sectional view illustrating a state where the movable terminal is fit in the base.
Figure 8B:
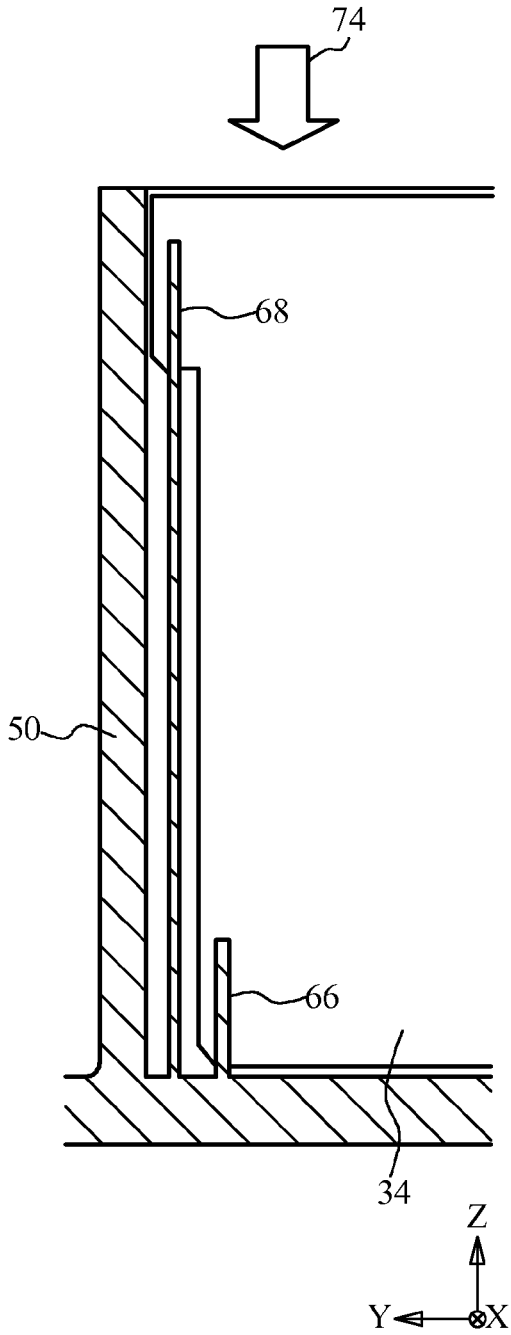

FIG. 8A and FIG. 8B are a front view and a cross-sectional view illustrating a state where the movable terminal is fit in the base 50, respectively. The movable terminal 34 is pressed into the slit 72 in the base 50 from a direction indicated with an arrow 74 in FIG. 8B. As illustrated in FIG. 8A and FIG. 8B, the rib 66 fixes the movable terminal 34 at a press rear side (−Z side) on an upper side thereof (+Y side), and the rib 64 fixes the movable terminal 34 at a press entrance side on the upper side. The rib 68 fixes the movable terminal 34 at the press rear side (−Z side) on a lower side thereof (−Y side), and the rib 69 fixes the movable terminal 34 at the press entrance side on the lower side. As described above, the movable terminal 34 is fixed at two points on each of the lower side and the upper side, and thus the movable terminal 34 can be strongly fixed. Therefore, the fabrication process such as application of adhesive can be eliminated. Furthermore, the protrusion 70 provided in the movable terminal 34 allows the rib 68 to fix the movable terminal 34. The ribs are used to fix the movable terminal 34 in the present embodiment, but may be used to fix the fixing terminal 42.

Figure 9A:
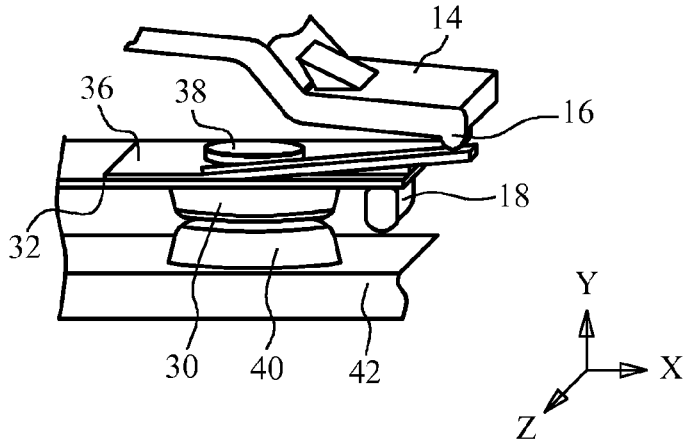
FIG. 9A and FIG. 9B are diagrams illustrating a movable spring and a contact spring.
Figure 9B:
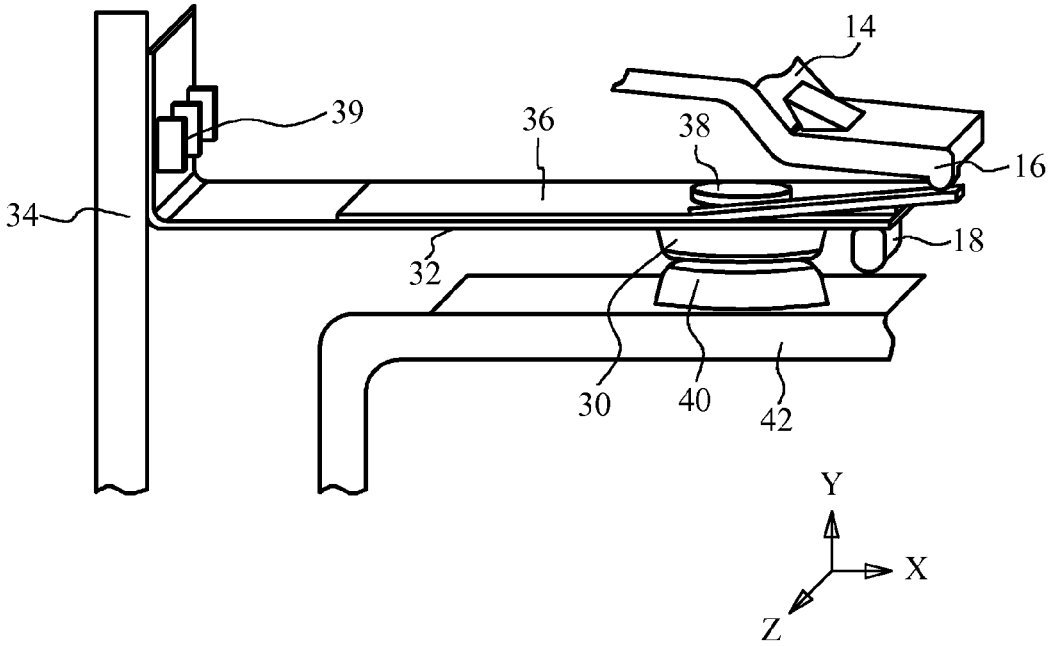

FIG. 9A and FIG. 9B are diagrams illustrating the movable spring and the contact spring. As illustrated in FIG. 9A, the contact spring 36 is located on the movable spring 32. The contact spring 36 is fixed to the movable spring 32 by a fixing portion 38 when the movable contact 30 is swaged. The movable spring 32 becomes a current pathway between the movable terminal 34 and the movable contact 30. Thus, the movable spring 32 is made of a material with a high conductivity. On the other hand, the contact spring 36 is separately provided, and thus the contact spring 36 can be made of a material with a high springiness. The movable spring 32 may be made of a copper alloy such as a Cu—Cr based alloy or Cu—Fe based alloy having a high conductivity. The contact spring 36 may be made of phosphor bronze such as a Cu—Sn based alloy with a high springiness. Furthermore, when the contact spring 36 is made of Cu—Cr—Zr—Si based alloy having a high conductivity and high springiness, a rise in temperature of the electromagnetic relay when current is applied can be reduced. In addition, the resistance of the spring to the repetitive action can be improved. The movable spring 32 may be made of Cu—Cr—Zr—Si based alloy.

As illustrated in FIG. 9B, the contact spring 36 extends close to the fixing portion 39 that fixes the movable spring 32 to the movable terminal 34. This configuration enables further reduction in a rise in temperature of the electromagnetic relay when current is applied. The electromagnetic relay illustrated in FIG. 9B reduces the temperature of the fixing terminal 42 when current is applied by 5° C. compared to the electromagnetic relay illustrated in FIG. 9A.

As described above, two or more plate-like elastic bodies such as the movable spring 32 and the contact spring 36 biasing the movable contact 30 are provided. The plate-like elastic bodies are fixed to each other at one point. The plate-like elastic bodies are not fixed to each other in a region other than the region where the plate-like elastic bodies are fixed to each other. Therefore, the springiness of the plate-like elastic body as a whole can be improved. The plate-like elastic bodies can be fixed at the movable contact 30.

The elastic body fixed to the movable terminal 34 (movable spring 32) of the plate-like elastic bodies preferably has a conductivity higher than those of other elastic bodies (contact spring 36). This configuration enables reduction of an electric resistance between the movable terminal 34 and the movable contact 30. Furthermore, other elastic bodies (contact spring 36) preferably have more springiness than the elastic body fixed to the movable terminal 34 (movable spring 32). This configuration enables improvement in the springiness of the plate-like elastic bodies. This configuration enables to improve the springiness of the plate-like elastic bodies.

As illustrated in FIG. 1, an insulative shield wall 54 is located between the electromagnet 20 and the movable terminal 34 and the fixing terminal 42. This configuration can insulate the electromagnet 20 from the movable terminal 34 and the fixing terminal 42, and suppress a dielectric breakdown. Therefore, the electromagnetic relay can be downsized. Furthermore, a coil wire length and coil wire volume of the electromagnet 20 can be increased. Thus, the efficiency in the attractive force of the electromagnet can be improved, and the driving electric power of the electromagnetic relay can be reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto, without departing from the spirit and scope of the invention.

What is claimed is:

1. An electromagnetic relay comprising:

a yoke capable of changing a magnetic pole thereof by an electromagnet;

an armature that is magnetized by a permanent magnet and contacts with or separates from the yoke in accordance with the magnetic pole of the yoke;

a movable contact that contacts with a fixing contact;

an elastic body that biases the movable contact; and a pressing member that presses the elastic body in accordance with a movement of the armature to cause the movable contact to contact with or separate from the fixing contact, wherein a cover, receiving the permanent magnet, the armature, and the pressing member are integrally molded together as one piece, wherein the pressing member includes— a first pressing portion that hits the elastic body at a first velocity, when the movable contact contacts the fixing contact, and that does not hit the elastic body when the movable contact separates from the fixing contact; and a second pressing portion that hits the elastic body at a second, greater velocity, when the movable contact separates from the fixing contact, and that does not hit the elastic body, when the movable contact contacts the fixing contact, and wherein a minimum distance from the elastic body to the second pressing portion, when the second pressing portion separates farthest from the elastic body, is greater than a minimum distance from the elastic body to the first pressing portion, when the first press portion separates farthest from the elastic body to create the second, greater velocity.

2. The electromagnetic relay according to claim 1, wherein a distance in a direction from a fulcrum of the elastic body to the movable contact from a position at which the movable contact is fixed to the elastic body to a position at which the first pressing portion contacts with the elastic body is greater than a distance in the direction from the fulcrum of the elastic body to the movable contact from a position at which the movable contact is fixed to the elastic body to a position at which the second pressing portion contacts with the elastic body.

3. The electromagnetic relay according to claim 2, wherein the first pressing portion and the second pressing portion press the elastic body at opposing sides in a direction perpendicular to a line connecting the fulcrum of the elastic body and the movable contact.

4. The electromagnetic relay according to claim 1, wherein the yoke is a pair of yokes, the armature is located so as to sandwich edge portions of the pair of yokes, and a rotation of the cover causes the armature and the edge portions to contact with or separate from each other.

5. The electromagnetic relay according to claim 4, further comprising:

a base that fixes the yoke, wherein a hole is formed in one of the base and the cover at a center of rotation of the cover, and a protrusion fitting in the hole is formed in the other of the base and the cover at the center of the rotation of the cover, the hole and the protrusion define an axis of the rotation of the cover, and a gap between the hole and the protrusion in an arrangement direction of the pair of yokes is less than a gap in a direction intersecting with the arrangement direction.

6. The electromagnetic relay according to claim 4, wherein a center of rotation of the cover is not located on a line connecting the pair of yokes.

7. The electromagnetic relay according to claim 1:

wherein the elastic body includes plate-like elastic bodies, wherein the plate-like elastic bodies are fixed to each other at one point.

8. The electromagnetic relay according to claim 7, wherein the one point is at the movable contact.

* * * * *